US007971767B2

(12) United States Patent
Komazaki et al.

(10) Patent No.: US 7,971,767 B2
(45) Date of Patent: Jul. 5, 2011

(54) DRIVING MACHINE

(75) Inventors: Yoshiichi Komazaki, Ibaraki (JP); Norikazu Baba, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 183 days.

(21) Appl. No.: 12/362,634

(22) Filed: Jan. 30, 2009

(65) Prior Publication Data

US 2009/0206120 A1 Aug. 20, 2009

(30) Foreign Application Priority Data

Jan. 31, 2008 (JP) ..... 2008-021591

(51) Int. Cl.
*B27F 7/02* (2006.01)

(52) U.S. Cl. ..... 227/8; 227/120; 227/130

(58) Field of Classification Search ..... 227/8, 9, 227/10, 120, 130
See application file for complete search history.

(56) References Cited

U.S. PATENT DOCUMENTS

| | | | | |
|---|---|---|---|---|
| 3,685,396 | A * | 8/1972 | Obergfell | 91/356 |
| 3,929,056 | A * | 12/1975 | Lange | 91/461 |
| 4,559,447 | A * | 12/1985 | Schlotter et al. | 250/231.18 |
| 6,953,137 | B2 * | 10/2005 | Nakano et al. | 227/8 |
| 7,308,995 | B2 * | 12/2007 | Uchiyama et al. | 227/8 |

FOREIGN PATENT DOCUMENTS

JP 2006-224271 8/2006

* cited by examiner

*Primary Examiner* — Paul R. Durand
*Assistant Examiner* — Nathaniel Chukwurah
(74) *Attorney, Agent, or Firm* — McDermott Will & Emery LLP

(57) ABSTRACT

When a push lever is brought in contact with a member to be driven, a second trigger stopper slides and a first trigger stopper slides via a second spring. After a third trigger stopper turns ON a push switch 18 according to sliding of the first trigger stopper, the first trigger stopper further slides and a projecting portion and a projecting portion of a trigger are disengaged from each other, so that the trigger is made rotatable. A trigger switch is turned ON according to rotation of the trigger.

9 Claims, 6 Drawing Sheets

DRIVING MACHINE

BACKGROUND OF THE INVENTION

1. Field of the Invention

The present invention relates to a driving machine driven by compressed air, flammable gas, an electric motor, or the like, and in particular to a driving machine which drives a fastener member into a member to be driven by turning-ON of a trigger after a push lever comes in contact with the member to be driven.

2. Description of the Related Art

There are driving machines utilizing compressed air, flammable gas, an electric motor or the like as a power source. Here, a driving machine utilizing flammable gas as a power source will be explained.

An action for driving a nail which is a fastener member will first be explained. A driving machine of this type includes a fuel canister therein to jet fuel from the fuel canister into a combustion chamber, thereby producing mixed gas. The combustion chamber is connected to a cylindrical cylinder and a piston movable in a vertical direction is accommodated in the cylinder. A push lever is pressed on a member to be driven and the trigger is pulled so that an spark plug ignites fuel. Gas in the combustion chamber combusts and a volume of mixed gas expands so that the piston is pressed downward. The piston is formed integrally with a rod-shaped driver blade and it is configured so as to drive a nail into a member to be driven such a wood.

Next, a structure of a switch will be explained. For safety, a portable type driving machine which does not include an external drive source such as a compressor adopts such a configuration that, after a push lever provided near a shooting port through which a nail is shot is brought in contact with a member to be driven to be pressed on the member to be driven, the trigger is pulled to start driving action. Such a switch structure is adopted that, unless the series of actions described above are performed, driving action is not performed. For example, such a configuration is adopted that, when the push lever is brought in contact with the member to be drive to be pressed thereon after the trigger is pulled, the driving machine cannot drive a nail into the member to be driven.

The driving machine of this type has a push switch which turns ON or OFF according to action of the push lever and a trigger switch which turns ON or OFF according to action of the trigger. The driving machine adopts such a configuration that, after the push switch turns ON, namely, unless the push lever is pressed on a member to be driven to be raised, the trigger switch does not turn ON. The driving machine with such a configuration is provided with a mechanism where, when the push lever is raised, the trigger switch turns ON together with a mechanism where, unless the push lever is raised, the trigger cannot be operated. Therefore, there is such a problem that the structure of the switch mechanism portion becomes complicated, which results in growth in size. Incidentally, Unexamined Japanese Patent Application KOKAI Publication No. 2006-224271 discloses a driving machine provided with a stopper member operating simultaneously with a trigger for preventing a combustion chamber frame from returning back to an initial position when a push lever is pressed so that a combustion chamber is formed.

There is also a driving machine where the abovementioned both switches are connected to a microcomputer accommodated in a housing. With this configuration, when the push lever is brought in contact with a member to be driven to be pressed on the same, a push switch turns ON via a link mechanism operating simultaneously with action of the push lever. The microcomputer senses such a fact that the push switch is in ON state by an electric signal. The microcomputer is programmed such that, when the trigger is then pulled so that the trigger switch turns ON, spark is generated at an spark plug. The driving machine adopts an electrical switch mechanism where the microcomputer is used. Since the switch mechanism requires the microcomputer, manufacturing cost is increased. Since the driving machine is frequently used outdoor, such a problem arises that the driving machine malfunctions due to noises generated by thunder or the driving machine is disabled by exposure to rain.

SUMMARY OF THE INVENTION

An object of the present invention is to provide a reliable driving machine provided with a switch mechanism portion of a mechanical type which can be manufactured at low cost.

The above object is achieved by a driving machine provided with a housing, a push lever provided so as to be movable in a longitudinal direction of the housing and be capable of abutting on a member to be driven, a push switch turned ON and OFF according to movement of the push lever, and a trigger switch turned ON and OFF according to trigger operation, where a fastener member is driven in the member to be driven by turning ON the trigger switch after turning ON the push switch, wherein the driving machine includes a switch mechanism portion whose portion abuts on one end of the push lever to slide in synchronism with movement of the push lever, thereby turning ON the push switch and making the trigger operable.

According to such a configuration, since the push lever is turned ON in synchronism with movement of the push lever and the trigger switch is made operable, the switch mechanism portion is configured with a simple configuration.

It is preferable that the present invention has a handle extending from a side portion of the housing and the switch mechanism portion is disposed between the housing and the handle. Further, it is preferable that the push switch is positioned on the side opposite to the push lever regarding the switch mechanism portion. With such a configuration, since the switch mechanism portion is disposed near the trigger and the push switch configuring an operation portion, the mechanical parts are reduced in size, which results in size reduction of the driving machine itself.

It is preferable that the switch mechanism portion comprises a first trigger stopper having an abutting portion abutting on the trigger, a second trigger stopper having a projecting portion inserted into a first hole portion of the first trigger stopper, the projecting portion sliding relative to the first hole portion in synchronism with action of the push lever, and a third trigger stopper inserted into a second hole portion of the first trigger stopper and capable of sliding relative to the second hole portion, and the first trigger stopper, the second trigger stopper, and the third trigger stopper are configured integrally. With such a configuration, the switch mechanism portion itself is reduced in size.

It is preferable that the present invention comprises a first spring disposed so as to receive a projecting portion of the first trigger stopper to bias the first trigger stopper, a second spring disposed so as to receive the projecting portion of the second trigger stopper and biasing the second trigger stopper when the projecting portion of the second trigger stopper is inserted into the first hole portion of the first trigger stopper, and a third spring disposed so as to receive the third trigger stopper and biasing the third trigger stopper when the third trigger stopper is inserted into the second hole portion of the first trigger stopper. With such a configuration, the push switch or the trigger switch can be prevented from being easily and erroneously pressed by biasing forces of the respective springs so that consumption of a battery can be suppressed.

It is preferable that, when the push lever does not contact with a member to be driven, the abutting portion of the first trigger stopper and the trigger abuts on each other, so that the trigger is made non-rotatable, and when the push lever contacts with the member to be driven, the abutting portion and the trigger is separated from each other, so that the trigger is made rotatable. With such a configuration, the push switch or the trigger switch can be prevented from being pressed easily and erroneously so that consumption of a battery can be suppressed.

It is preferable that spring force of the second spring is larger than the sum of spring forces of the first spring and the third spring. With such a configuration, the first trigger stopper is pushed upwardly according to movement of the second trigger stopper so that the push switch can be turned ON easily and the trigger can be operated.

According to the present invention, such a switch mechanism portion that the trigger is not operated unless the push lever comes in contact with a member to be driven is simply configured as an integral unit. Since the switch mechanism portion comprises mechanical parts, erroneous action of the driving machine can be prevented from occurring due to disturbance of thunder noises or rain and the like. Further, since the switch mechanism portion comprises mechanical parts, a reliable product can be provided.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

An embodiment of the present invention will be explained below with reference to FIG. 1 to FIG. 8. A configuration of a driving machine according to the present invention will first be explained with reference to FIG. 1.

Figure 1:
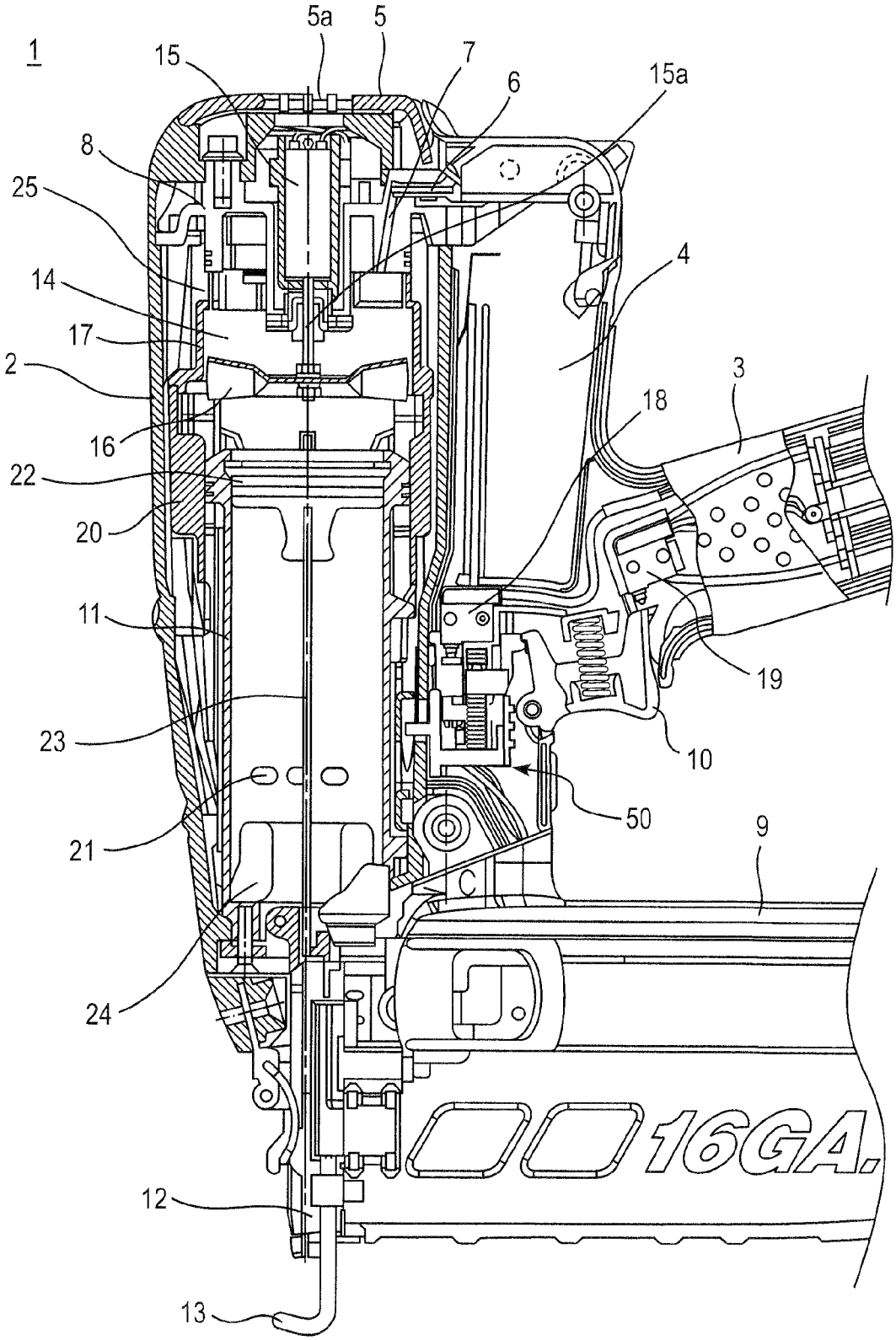
FIG. 1 is a sectional view showing a driving machine according to the present invention.

FIG. 1 shows an example of an embodiment of the present invention and is a partial sectional view of a driving machine (a combustion type driving machine) utilizing flammable gas as a power source. A driving machine 1 comprises a housing (a main body portion) 2 mainly configuring an outer frame and a handle 3 provided to extend from a side portion of the housing 2. A canister chamber 4 which accommodates a gas canister (not shown) in attachable and detachable manner is formed within the housing 2 between the housing 2 and the handle 3. A fuel passage 7 to which a nozzle 6 of a gas canister is connected, for introducing flammable liquefied gas into a combustion chamber 14 described later, is formed in a cylinder head 8 described later.

A head cover 5 formed with a suction port 5*a* is attached to an upper portion of the housing 2. A trigger 10 is provided between the housing 2 and the handle 3 below the canister chamber 4. A battery pack (not shown) is attached to an end portion of the handle 3 in an attaching and detaching manner.

A magazine 9 loaded with nails (not shown) is provided on the housing 2 on the side opposite to the head cover 5 below the handle 3. A cylinder 11 is connected near an end portion of the housing 2 on the side opposite to the head cover 5, and a nose 12 facing a member to be driven is provided at a distal end portion of the cylinder 11. The nose 12 guides sliding of a driver blade 23 and driving of a nail (not shown) driven in a member to be driven. A push lever 13 abutting on a member to be driven projects from a distal end (a side opposite to the housing 2) of the nose 12 to be supported in a reciprocating and sliding manner. The push lever 13 is coupled to a combustion chamber frame 17 described later. An upper end portion (a first rink mechanism 33) of the push lever 13 can abut on a second trigger stopper 28 configuring a switch mechanism portion 50 of the present invention.

The switch mechanism portion 50 is provided between the housing 2 and the handle 3 on a lower side of the canister chamber 4. As described later, the switch mechanism portion 50 is configured such that, when the push lever 13 rises, the push switch 18 is turned ON and trigger 10 is operable (a trigger switch 19 can be turned ON). The switch mechanism portion 50 comprises mechanical parts, where the mechanical parts are configured as an integrated unit. The push switch 18 is positioned just above the switch mechanism portion 50 and the trigger 10 is provided near the handle 3 of the switch mechanism portion 50. Thus, the switch mechanism portion 50 is reduced in size and it can be arranged without occupying a large space.

Such a configuration is adopted that, when a distal end of the push lever 13 abuts on a member to be driven so that the housing 2 (the driving machine 1) is pressed on the member to be driven, a portion of the push lever 13 positioned near the housing 2 can be moved into the housing 2. A cylinder head 8 for covering an opening of the housing 2 is fixed at an end portion of the housing 2 on the side opposite to the push lever 13. A motor 15 is disposed in the cylinder head 8 on the side opposite to the combustion chamber 14. A spark plug (not shown) is provided near the motor 15.

A spark position of the spark plug faces is located internally in the combustion chamber 14, and the push switch 18 described later is turned ON according to a pressing action of the push lever 13 and the trigger switch 19 described later is turned ON according to operation of the trigger 10 so that the spark plug is ignited. The motor 15 includes a rotational shaft 15*a*. A fan 16 is fixed at an end portion of the rotational shaft 15*a* positioned within the combustion chamber 14.

A fuel passage 7 is formed within a portion of the cylinder head 8 positioned on the side of the handle 3. One end of the fuel passage 7 is opened to a lower end face of the cylinder head 8 to face the combustion chamber 14, while the other end thereof is connected to a nozzle 6 of a gas canister attached to the cylinder head 8. The combustion chamber frame 17 movable in a longitudinal direction of the housing 2 simultaneously with action of the push lever 13 is provided within the housing 2.

A push switch 18 for detecting such a fact that the combustion chamber frame 17 has been positioned at a stroke end (an ascent position) according to pressing of the driving machine 1 on a member to be driven is provided within the housing 2. When the push lever 13 moves to a predetermined ascent position, the push switch 18 turns ON and the motor 15 rotates the fan 16.

Since a second link mechanism 20 connected to the push lever 13 is connected to the combustion chamber frame 17, the combustion chamber frame 17 moves via the second link mechanism 20 according to movement of the push lever 13. The cylinder 11 guiding movement of the combustion chamber frame 17 is fixed the housing 2 on an inner circumferential portion of the combustion chamber frame 17. An exhaust hole 21 is formed near a central portion of the cylinder 11 in an axial direction thereof. A check valve (not shown) is provided to the exhaust hole 21 so that the exhaust hole 21 is selectively closed.

A piston 22 movable in a reciprocating manner to the cylinder 11 is provided within the cylinder 11. The piston 22 defines a space in the cylinder 11 into a piston upper chamber and a piston lower chamber. A driver blade 23 extends from a surface of the piston lower chamber of the piston 22 toward the nose 12. A distal end of the driver blade 23 drives a nail. A bumper 24 comprising an elastic body is disposed in a lower portion with the cylinder 11. Thereby, when the piston 22 moves downward to reach a bottom dead center, the piston 22 collides against the bumper 24 so that impact of the driving machine 1 occurring at a driving time of a nail is absorbed.

When the push lever 13 is pressed on a member to be driven so that an upper end portion of the combustion chamber frame 17 abuts on the cylinder head 8, the combustion chamber 14 is defined by the cylinder 11, the combustion chamber frame 17, and the piston 22. When the combustion chamber frame 17 is spaced from the cylinder head 8, an air passage 25 occurs between the cylinder head 8 and an upper end portion of the combustion chamber frame 17. The air passage 25 allows passing of combustion gas or fresh air toward an outer peripheral face of the cylinder 11. Past combustion gas or the like is exhausted from an exhaust port of the housing 2. The suction port 5*a* is formed for supplying air to the combustion chamber 14. Combustion gas within the combustion chamber 14 is exhausted from the exhaust hole 21.

Rotation of the fan 16 accomplishes three functions. A first function is that, when the combustion chamber frame 17 is positioned at a position at which it abuts on the cylinder head 8, the fan 16 mixes air and flammable gas in an agitating manner to cause turbulent combustion after ignition, thereby facilitating the combustion. Second and third functions are that, when the combustion chamber frame 17 is separated from the cylinder head 8 so that the air passage 25 occurs, the fan 16 scavenges combustion gas within the combustion chamber 14 and cools the cylinder 11.

Next, an operation of the driving machine 1 will be explained. In a state that an action for driving a nail is not performed, as also shown in FIG. 1, the push lever 13 projects most from the lower end of the nose 12 in a direction opposite to the piston 22. At this time, since the combustion chamber frame 17 is continuously connected to the push lever 13 via the second link mechanism 20, the upper end portion of the combustion chamber frame 17 is spaced from the cylinder head 8 so that the air passage 25 is formed. At this time, the piston 22 stops at a top dead center within the cylinder 11.

In this state, when the handle 3 is grasped by an operator and the push lever 13 is pressed on a member to be driven, the push lever 13 is moved toward the piston 22. Further, since the combustion chamber frame 17 continuously connected to the push lever 13 via the second link mechanism 20 also rises, the air passage 25 is closed so that the combustion chamber 14 is formed in a sealed state.

Liquefied gas is jetted from the gas canister according to movement of the push lever 13. Liquefied gas is supplied into the combustion chamber 14 through the nozzle 6 and the fuel passage 7. Further, when the combustion chamber frame 17 moves up to the stroke end (the ascent position) according to movement of the push lever 13, the push switch 18 is turned ON, as described later. Power is supplied from the battery pack (not shown) to the motor 15, so that the fan 16 attached to the rotational shaft 15*a* is rotated. According to rotation of the fan 16 within the combustion chamber 14 configuring a sealed space, flammable gas jetted is mixed with air within the combustion chamber 14 in an agitating manner.

In this state, when the trigger 10 of the handle 3 is operated so that the trigger switch 19 is turned ON, the spark plug (not shown) is sparked so that the mixed gas is ignited to burn and inflate. The burned and inflated mixed gas moves the piston 22 toward the push lever 13. A nail supplied from the magazine 9 to be positioned in the nose 12 is driven into the member to be driven by the driver blade 23 moved together with the piston 22. At this time, the piston 22 collides against the bumper 24 provided within the cylinder 11.

After driving, the piston 22 contacts with the bumper 24 and combustion gas is discharged from the exhaust hole 21 outside the cylinder 11. The check valve is provided corresponding to the exhaust hole 21. When combustion gas is discharged outside the cylinder 11 and pressure within the cylinder 11 and the combustion chamber 14 becomes equal to the atmospheric pressure, the check valve is closed.

Combustion gas remaining in the cylinder 11 and the combustion chamber 14 due to just after combustion remains in high temperature. The combustion heat is absorbed from an inner wall of the cylinder 11 and an inner wall of the combustion chamber frame 17 so that the cylinder 11, the gas canister, and the like reach high temperatures. The absorbed heat is dissipated from outer wall surfaces of the cylinder 11 and the combustion chamber frame 17 to the atmosphere. The combustion gas is rapidly cooled due to absorption of the combustion heat of the combustion gas in the cylinder 11 and the like. The volume of the combustion gas decreases so that pressure in a closed space (the combustion chamber 14) above the piston 22 lowers. When the pressure in the combustion chamber 14 lowers down to the atmospheric pressure or less (thermal vacuum), the piston 22 is pulled back to the initial top dead center (a state shown in FIG. 1).

Thereafter, when a finger of the operator is released from the trigger 10, the trigger switch 19 is turned OFF. When the driving machine 1 is left up so that the push lever 13 is separated from the member to be driven, the push lever 13 and the combustion chamber frame 17 return back to the side opposite to the cylinder head 8 so that the air passage 25 is formed. Even after the trigger switch 19 is turned OFF, the fan 16 continues to rotate for a fixed time. Rotation of the fan 16 generates flow of air so that fresh air is taken in from the suction port 5*a* of the head cover 5. The air is discharged from the exhaust port through the combustion chamber 14 and the like so that air within the combustion chamber 14 is scavenged.

Next, a structure of the switch mechanism portion 50 where the push switch 18 and the trigger switch 19 configuring the present invention operate will be explained with reference to FIG. 2 and FIG. 3.

Figure 2:
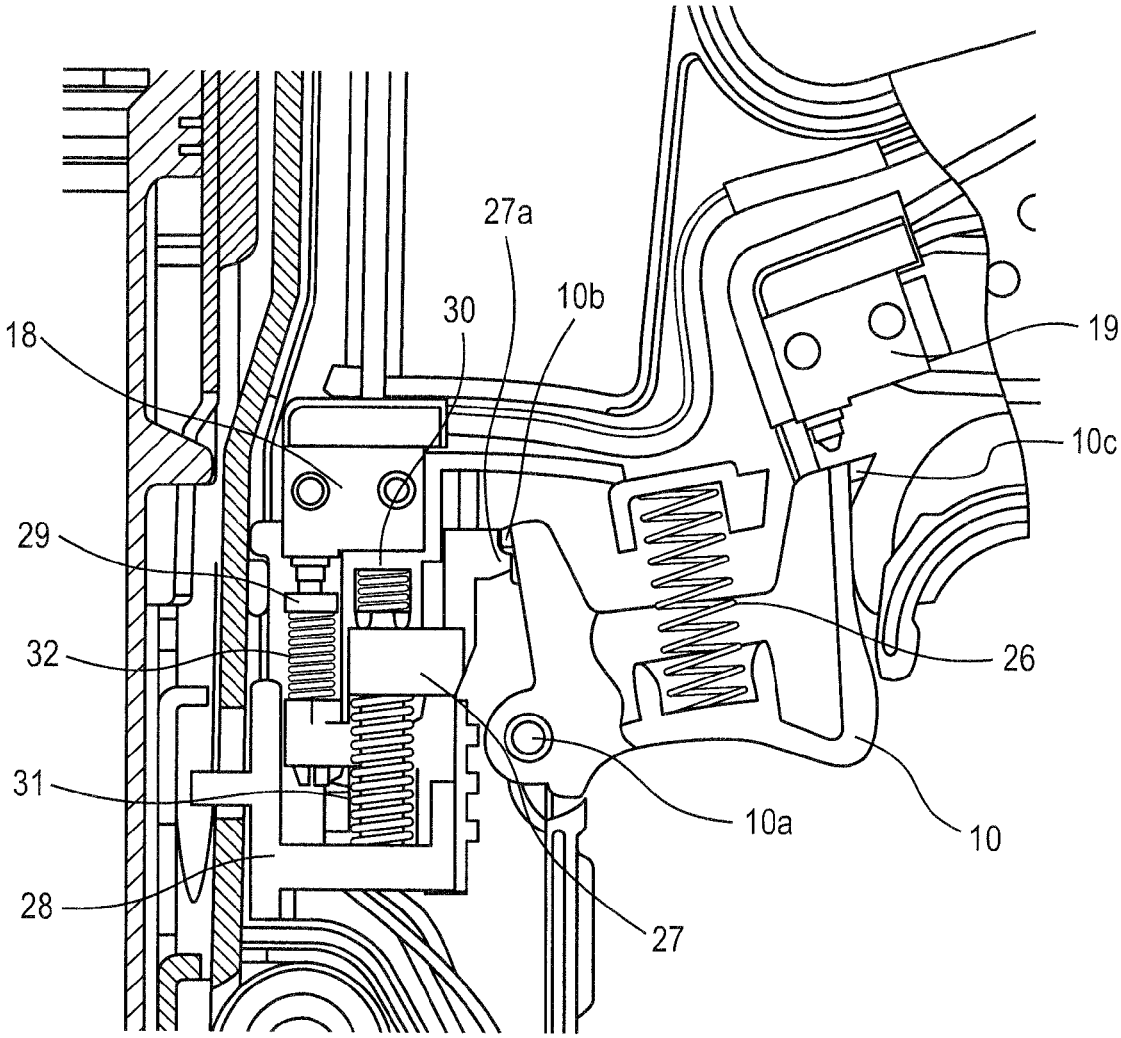
FIG. 2 is a partial sectional view of the driving machine showing a state that a switch mechanism of the present invention is disposed in the driving machine.
Figure 3:
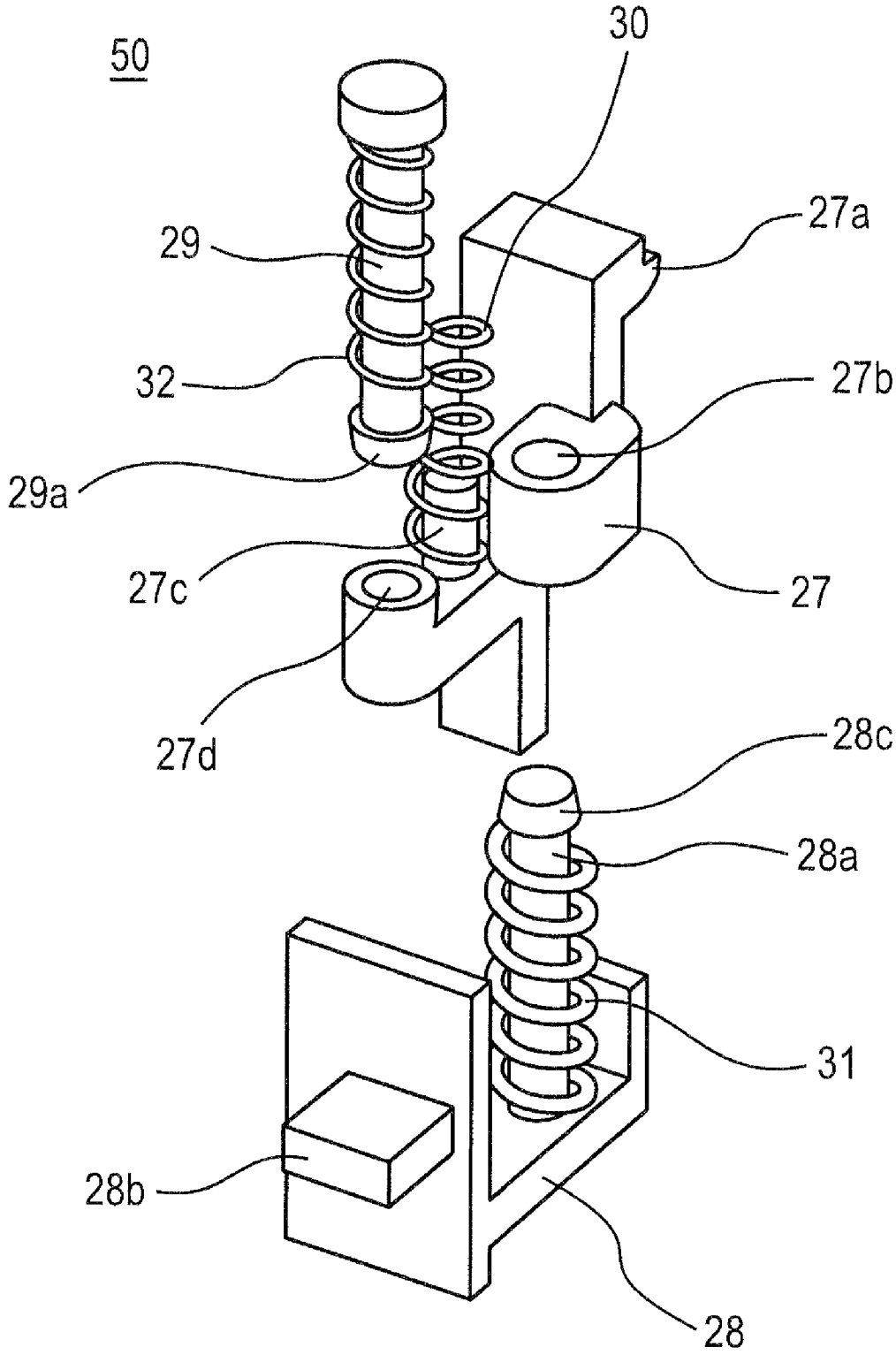
FIG. 3 is a dissolved perspective view showing the switch mechanism portion of the present invention.

FIG. 2 is a configuration view showing a state that the switch mechanism of the present invention has been attached to the driving machine 1, and FIG. 3 is a perspective view of the switch mechanism portion of the present invention.

As shown in FIG. 2, the switch mechanism portion 50 is disposed below the canister chamber 4 between the housing 2 and the handle 3 without occupying a large space. The trigger 10 is biased toward the side opposite to the trigger switch 19 by a trigger spring 26. The trigger 10 is rotatable about a shaft portion 10*a* while its rotational angle is limited by a guide of the housing 2. A projecting portion 10*b* is provided at a portion of the trigger 10 positioned on the side of the push switch 18. The projecting portion 10*b* is engaged with a projecting portion 27*a* of a first trigger stopper 27 configuring a portion of the switch mechanism portion 50 described later. When the projecting portion 10*b* is in engagement with the projecting portion 27*a*, the trigger 10 cannot be rotated about the shaft portion 10*a*.

As shown in FIG. 2 and FIG. 3, the switch mechanism portion 50 is disposed below the push switch 18. The switch mechanism portion 50 mainly comprises the first trigger stopper 27 formed with the projecting portion 27*a* engaged with the projecting portion 10*b* of the trigger 10, a second trigger stopper 28 capable of abutting on an end portion of the first link mechanism 33 of the push lever 13 described later, and a third trigger stopper 29 capable of abutting on the push switch 18.

The first trigger stopper 27 is provided with the projecting portion 27*a* engaged with the projecting portion 10*a* of the trigger 10, a hole portion 27*b* in which a shaft portion 28*a* of the second trigger stopper 28 is slidably inserted, and a shaft portion 27*c* extending in a longitudinal direction of the first trigger stopper 27. The shaft portion 27*c* is inserted into a first spring 30 disposed above the shaft portion 27*c* so as to guide one end of the first spring 30. The other end of the first spring 30 is disposed at a portion of the housing 2. A hole portion 27*d* is provided at a portion of the first trigger stopper 27. The third tipper stopper 29 formed in a rode shape is slidably inserted in the hole portion 27*d*.

The second trigger stopper 28 includes the shaft portion 28*a* formed with a taper-like retaining portion 28*c*. The shaft portion 28*a* is inserted into a second spring 31 and it is inserted in a hole portion 27*b* of the first trigger stopper 27 so as to be slidable and so as not to get out of the hole portion 27*b*. An abutting portion 28*b* abutting on the first link mechanism 33 described later is provided on the second trigger stopper 28 on the side opposite to the handle 3 in a projecting manner.

The third trigger stopper 29 includes a taper-like retaining portion 29*a* and it is slidably inserted into the hole portion 27*d* of the first trigger stopper 27. A third spring 32 is disposed on an outer periphery of the third trigger stopper 29 so as to be biased by the first trigger stopper 27.

The second spring 31 is disposed on the shaft portion 28*a* of the second trigger stopper 28, and the shaft portion 28*a* is inserted into the hole portion 27*b* of the first trigger stopper 27 so that the second trigger stopper 28 is slidable in upward and downward direction relative to the first trigger stopper 27. The second spring 31 biases the second trigger stopper 28 toward the push lever 13. The third trigger stopper 29 is disposed within the third spring 32 and it is inserted into the hole portion 27*d* of the first trigger stopper 27, so that the third trigger stopper 29 is made movable in upward and downward directions relative to the first trigger stopper 27. The third spring 32 biases the third trigger stopper 29 on the side opposite to the push lever 13. Further, the first spring 30 is disposed so as to receive the shaft portion 27*c* of the first trigger stopper 27 and the switch mechanism portion 50 is attached to the housing 2 as shown in FIG. 2. At this time, the first spring 30 biases the first trigger stopper 27 toward the push lever 13.

Next, an operation of the switch mechanism portion 50 will be explained with reference to FIG. 4 to FIG. 8. FIG. 4 to FIG. 8 are operation views showing an operation of the switch mechanism portion 50 of the present invention.

Figure 4:
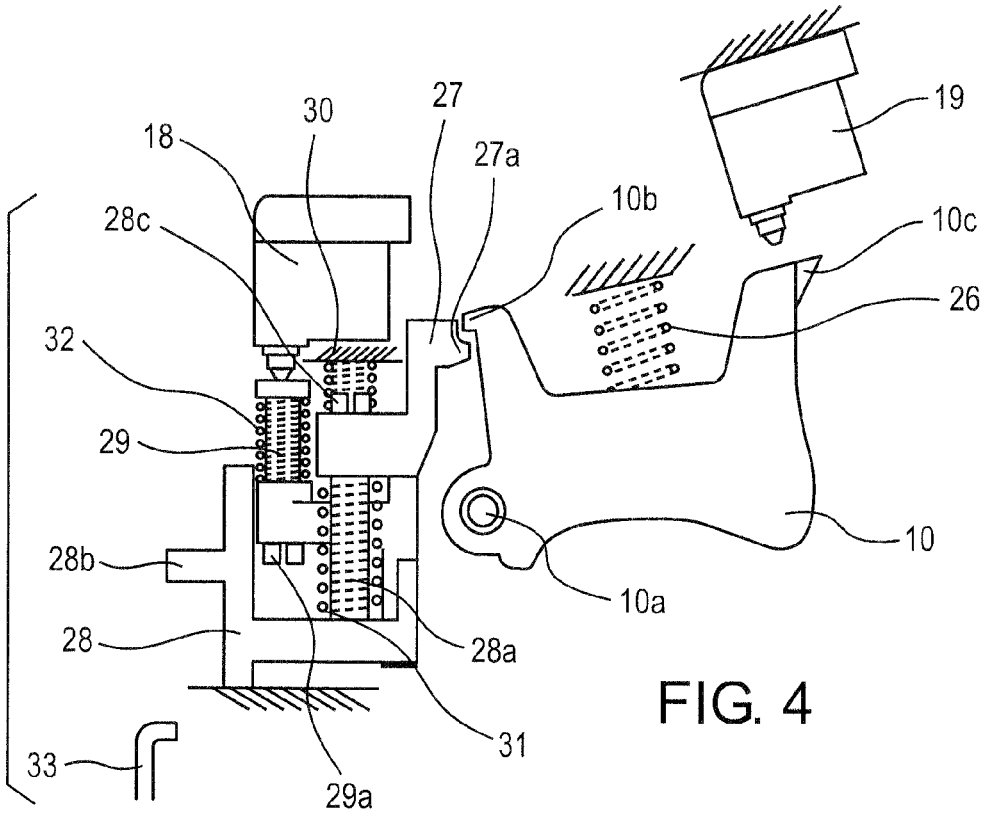
FIG. 4 is an operation view of the switch mechanism portion before driving of the driving machine of the present invention.

FIG. 4 shows the switch mechanism portion 50 put in a state where the push lever 13 does not contact with a member to be driven before action for driving a nail. In FIG. 4 to FIG. 8, hatching portions show fixing portions provided on the housing 2. Here, the push switch 18 and the trigger switch 19 are fixed to the housing 2, respectively. Each of the trigger stoppers 27, 28, and 29 is held by a guide of the housing 2 (not shown) so as to be movable in only upward and downward directions in FIG. 4 to FIG. 8.

The first trigger stopper 27 and the second trigger stopper 28 are biased downwardly (toward the push lever 13) by the first spring 30 and the second spring 31, respectively. The third trigger stopper 29 is biased upwardly (in a direction opposite to the push lever 13) by the third spring 32. At this time, the third trigger stopper 29 and the push switch 18 is not in contact with each other.

Figure 5:
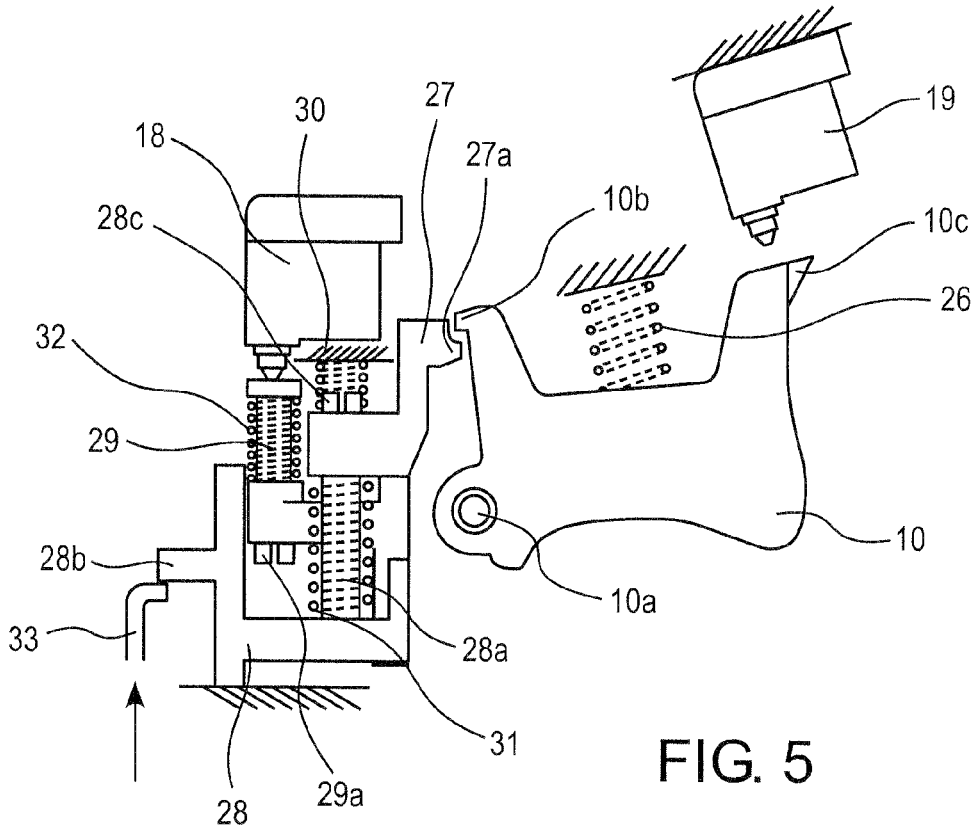
FIG. 5 is an operation view of the switch mechanism portion showing a state that the driving machine of the present invention has come in contact with a member to be driven but before it performs driving.

From a state before the driving action, the driving machine 1 is pressed on a member to be driven, the push lever 13 comes in contact with the member to be driven, and the push lever 13 moves upwardly (toward the head cover 5), so that the switch mechanism portion 50 is put in a state that driving action can be performed, as shown in FIG. 5. According to upward movement of the push lever 13, the end portion of the first link mechanism 33 moved vertically simultaneously with movement of the push lever 13 comes in contact with the abutting portion 28*b* of the second trigger stopper 28. The push lever 13 is pushed upwardly in a direction of arrow in FIG. 5 by further pressing the driving machine 1 onto the member to be driven. The end portion of the first link mechanism 33 of the push lever 13 pushes the second trigger stopper 28 upwardly so that the switch mechanism portion 50 reaches a state shown in FIG. 6. Incidentally, in the states shown in FIG. 4 and FIG. 5, the push switch 18 is not pushed and the projecting portion 10*b* of the trigger 10 abuts on the projecting portion 27*a* of the first trigger stopper 27. Therefore, the trigger 10 cannot be operated. That is, a driving action cannot be performed.

The second trigger stopper 28 is pushed by the first link mechanism 33 upwardly toward the push switch 18 against biasing force of the second spring 31. Thereby, since the end portion of the first trigger stopper 27 positioned on the side of the push lever 13 abuts on the upper face of the second trigger stopper 28, the first trigger stopper 27 is also pushed upwardly toward the push switch 18 against biasing force of the first spring 30. Incidentally, a distance of pushing-up of the second trigger stopper 28 is limited to a range till an end face of the second trigger stopper 28 positioned on the side of the retaining portion 28*c* abuts on the housing 2. Further, the third trigger stopper 29 is inserted into the hole portion 27*d* of the first trigger stopper 27 via the third spring 32. Therefore, the third spring 32 is compressed by the first trigger stopper 27 against biasing force thereof and the third trigger stopper 29 is pushed upwardly by the third spring 32. The end portion of the third trigger stopper 29 abuts on the push switch 18 according to upward movement of the third trigger stopper 29. The push switch 18 is turned ON by further pushing the push switch 18.

Here, spring force of the second spring 31 is set to be larger than the sum of spring forces of the first spring 30 and the third spring 32. Therefore, the first trigger stopper 27 is also pushed upwardly according to movement of the second trigger stopper 28. The spring force of the third spring 32 is set to be equal to or larger than load required for pushing in the push switch 18. Therefore, the push switch 18 is turned ON by the third trigger stopper 29. When the push switch 18 is turned ON, the fan 16 attached to the rotational shaft 15*a* of the motor 15 starts rotating. Flammable gas is jetted from the gas canister into the combustion chamber 14, and air and gas are agitated by rotation of the fan 16.

The first trigger stopper 27 is also moved upwardly simultaneously with upward movement of the second trigger stopper 28. Thereby, the projecting portion 27*a* of the first trigger stopper 27 abuts on the projecting portion 10*b* of the trigger 10 so that the trigger 10 is rotated in a direction of arrow shown in FIG. 6. Therefore, the projecting portion 27*a* is disengaged from the projecting portion 10*b*, so that the trigger 10 becomes rotatable about the shaft portion 10 and becomes operable. Incidentally, since the projecting portion 10*b* of the trigger 10 is engaged with the projecting portion 27*a* of the first trigger stopper 27 in the state shown in FIG. 4, the trigger 10 cannot rotate so that the trigger switch 19 is not turned ON.

Figure 6:
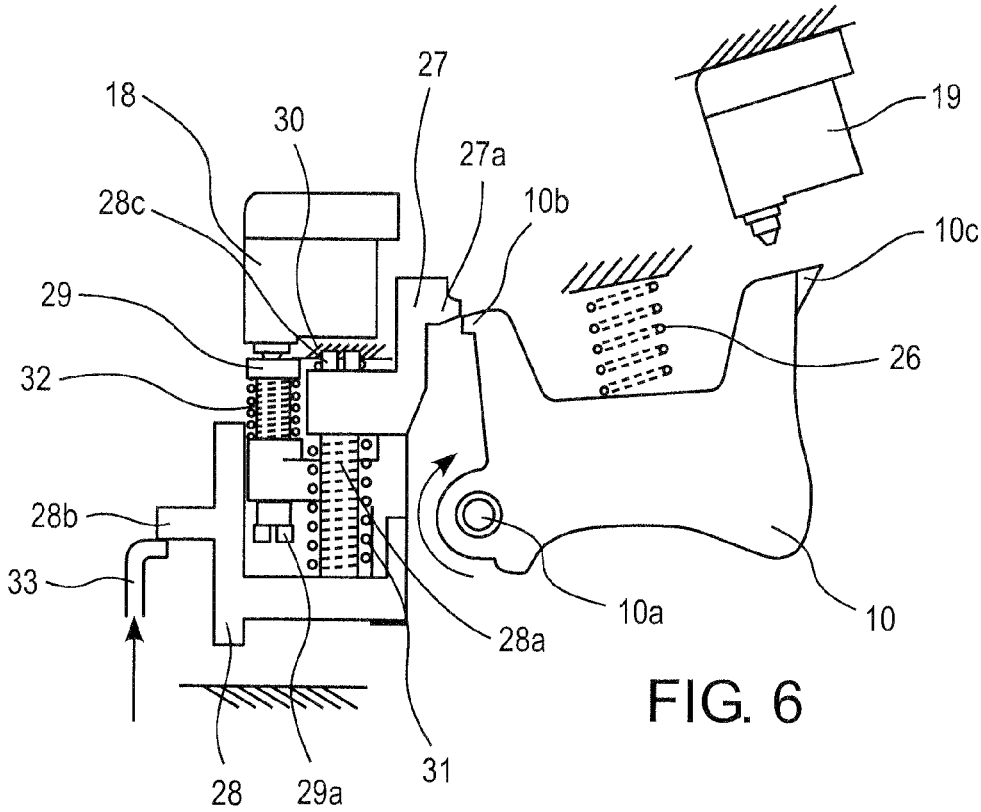
FIG. 6 is an operation view of the switch mechanism portion showing a state that the driving machine of the present invention has been pressed on the member to be driven.
Figure 7:
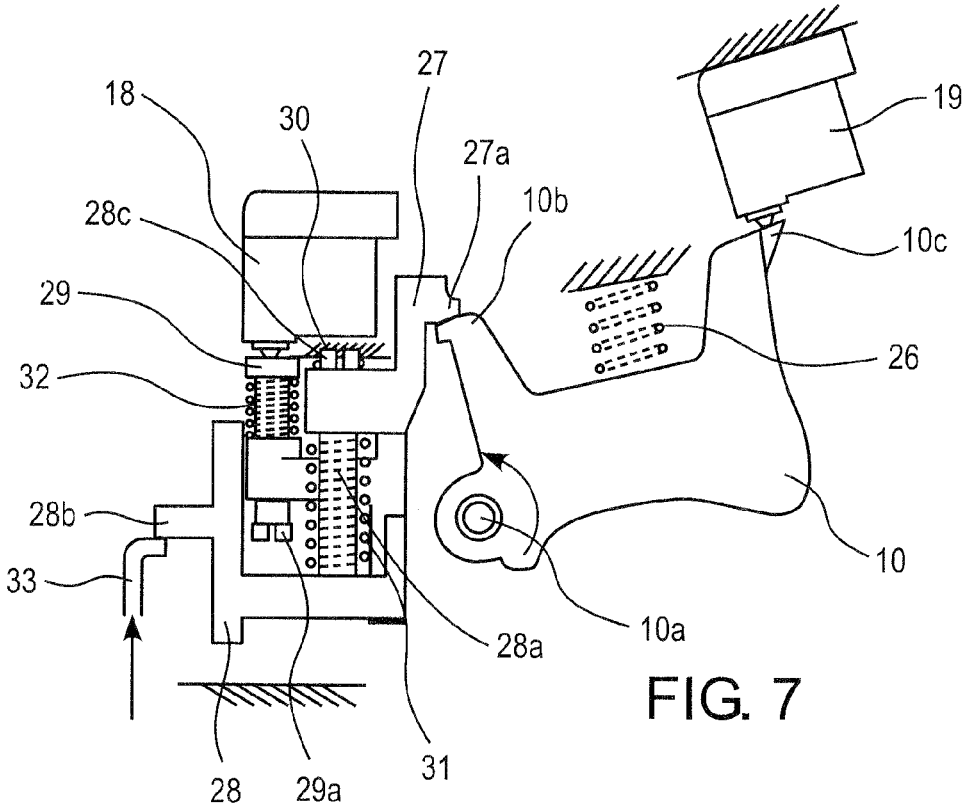
FIG. 7 is an operation view of the switch mechanism portion showing a state that a trigger of the driving machine of the present invention has been pulled.

When an operator operates the trigger 10 from the state shown in FIG. 6, the switch mechanism portion 50 becomes a state shown in FIG. 7. When the trigger 10 is operated, namely, when the trigger 10 rotates about the shaft portion 10*a* in a counterclockwise direction shown by arrow in FIG. 7, a contact portion 10*c* of the trigger 10 positioned on the side of the trigger switch 19 abuts on the trigger switch 19. When the trigger 10 is further rotated, the trigger switch 19 is turned ON, so that the spark plug is sparked to perform driving action of the driving machine 1.

That is, the first trigger stopper 27 and the second trigger stopper 28 are moved upwardly (toward the push switch 18) according to pressing of the push lever 13 on the member to be driven. According to the movement, the third trigger stopper 29 also moves and a surface thereof on the side of the retaining portion 29*a* turns ON the push switch 18. Further, the trigger 10 is made operable according to movement of the first trigger switch 27. According to rotation of the trigger 10 about the shaft portion 10*a* in the direction of arrow shown in FIG. 7, the contact portion 10*c* of the trigger 10 turns ON the trigger switch 19. Accordingly, by turning-ON of both the switches 18 and 19, driving action of the driving machine 1 is performed.

The process of the operation of the switching mechanism portion 50 of the present invention has been explained above. Next, durability of the switch mechanism portion 50 will be explained. When the driving machine 1 (the push lever 13) is brought in contact with a member to be driven speedily and swiftly, even if the third trigger stopper 29 collides against the push switch 18, the third spring 32 relaxes such impact force. Therefore, damage of the push switch 18 can be prevented.

Figure 8:
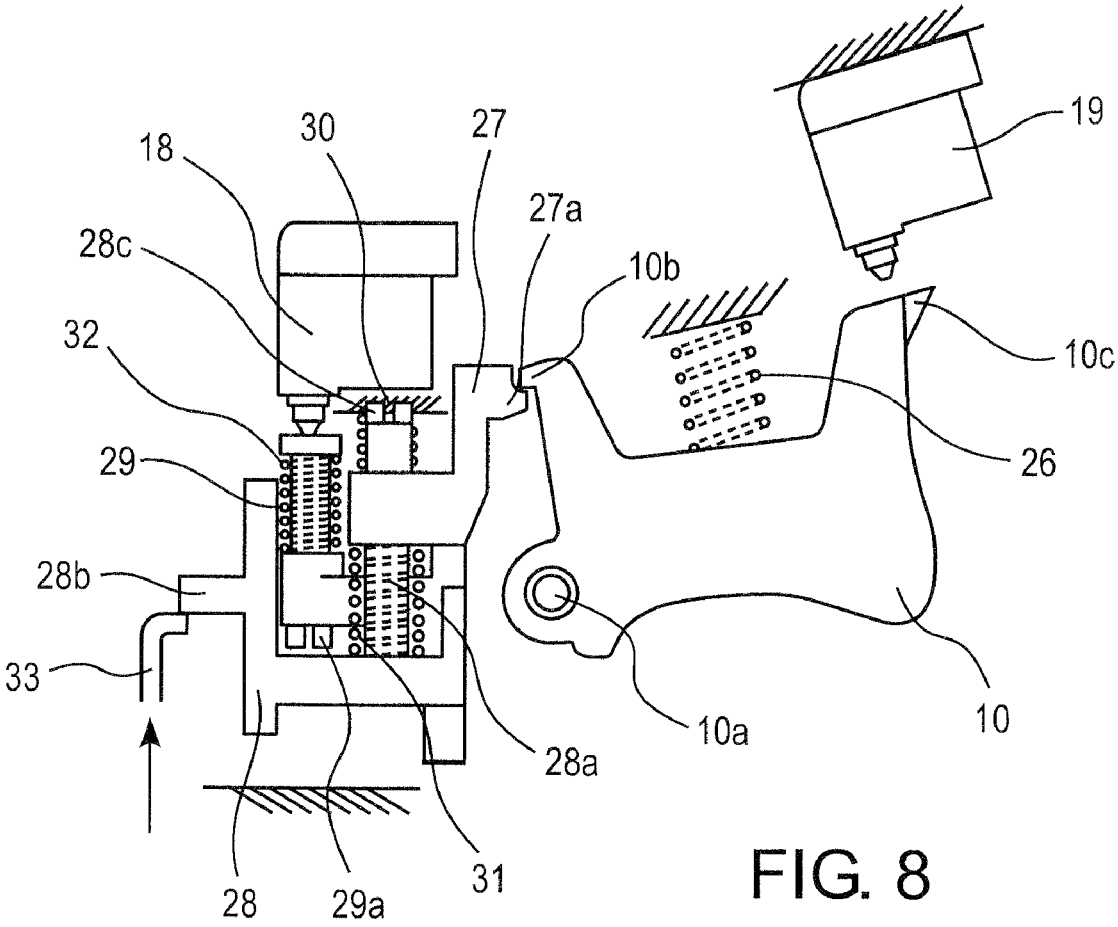
FIG. 8 is an operation view of the switch mechanism portion showing a state that the driving machine has been pressed on the member to be driven by application of pulling load on the trigger of the present invention.

FIG. 8 shows the switch mechanism portion 50 when the push lever 13 is pressed on a member to be driven after the trigger 10 is operated. When the push lever 13 is pushed in this state, the second trigger stopper 28 is moved upwardly via the first link mechanism portion 33. However, since the projecting portion 10*a* of the trigger 10 is engaged with the projecting portion 27*a* of the first trigger stopper 27, the first trigger stopper 27 is fixed without being moved upwardly. In this state, since load from the second trigger stopper 28 is relaxed by the second spring 31, force for pushing the first trigger stopper 27 forcibly is relaxed. Therefore, the first trigger stopper 27 (especially, the projecting portion 27*a*) or the projecting portion 10*a* of the trigger 10 can be prevented from being damaged.

As explained above, since the switch mechanism portion 50 comprises mechanical parts, malfunction of the switch mechanism portion due to disturbance such as thunder noises can be prevented. Since springs are used for the switch mechanism portion, even if the driving machine is pressed on a member to be driven swiftly, impact due to such swift pressing can be absorbed. Therefore, the push switch, the trigger, or the like can be prevented from being damaged. Further, since such a configuration that the trigger can be operated simultaneously with movement of the push lever is arranged at one place, the switch mechanism portion can be reduced in size and the driving machine itself can be reduced in size.

The combustion-type driving machine utilizing flammable gas as the power source has been explained above as the driving machine adopting the switch mechanism portion, but the switch mechanism portion can be applied to a compression air type driving machine or an electric motor type driving machine, or another electric motor tool operated utilizing two switches.

As described above, the push switch is provided at a connection portion with the handle on the side face of the housing and below the canister chamber. Thereby, as compared with a conventional configuration where the push switch is provided above the cylinder, it is not required to provide a link mechanism for turning ON the push switch extending from the push lever upwardly beyond the cylinder. Therefore, a size of the cylinder in its diametrical direction can be reduced in size.

Various embodiments and changes may be made thereunto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. 2008-021591 filed on Jan. 31, 2008 and including specification, claims, drawings and summary. The disclosure of the above Japanese Patent Application is incorporated herein by reference in its entirety.

What is claimed is:

1. A driving machine comprising:

a housing;

a push lever provided so as to be movable in a longitudinal direction of the housing and capable of abutting on a member to be driven;

a push switch turned ON and OFF according to movement of the push lever; and a trigger switch turned ON and OFF according to trigger operation, where a fastener member is driven by turning ON the trigger switch after turning ON the push switch, wherein the driving machine includes a switch mechanism portion whose portion abuts on one end of the push lever to slide in synchronism with movement of the push lever, thereby being capable of turning ON the push switch and making the trigger operable, wherein the switch mechanism portion comprises:

a first trigger stopper including an abutting portion abutting on the trigger; and a second trigger stopper sliding relative to the first trigger stopper in synchronism with action of the push lever.

2. The driving machine according to claim 1, further comprising a third trigger stopper inserted into a second hole portion of the first trigger stopper and capable of sliding relative to the second hole portion, wherein the first trigger stopper, the second trigger stopper, and the third trigger stopper are configured integrally.

3. A driving machine comprising:

a housing;

a push lever provided so as to be movable in a longitudinal direction of the housing and capable of abutting on a member to be driven;

a push switch turned ON and OFF according to movement of the push lever; and a trigger switch turned ON and OFF according to trigger operation, where a fastener member is driven by turning ON the trigger switch after turning ON the push switch, wherein the driving machine includes a switch mechanism portion whose portion abuts on one end of the push lever to slide in synchronism with movement of the push lever, thereby being capable of turning ON the push switch and making the trigger operable wherein the switch mechanism portion comprises:

a first trigger stopper including an abutting portion abutting on the trigger;

a second trigger stopper including a projecting portion inserted into a first hole portion of the first trigger stopper, the projecting portion sliding relative to the first hole portion in synchronism with action of the push lever; and a third trigger stopper inserted into a second hole portion of the first trigger stopper and capable of sliding relative to the second hole portion, wherein the first trigger stopper, the second trigger stopper, and the third trigger stopper are configured integrally.

4. The driving machine according to claim 3, further comprising a handle extending from a side portion of the housing, wherein the switch mechanism portion is disposed between the housing and the handle.

5. The driving machine according to claim 3, wherein the push switch is positioned on the side of the switch mechanism portion opposite to the push lever.

6. The driving machine according to claim 3, wherein the switch mechanism portion comprises:

a first spring disposed so as to receive a projecting portion of the first trigger stopper and biasing the first trigger stopper;

a second spring disposed so as to receive a projecting portion of the second trigger stopper and biasing the second trigger stopper when the projecting portion of the second trigger stopper is inserted in the first hole portion of the first trigger stopper; and a third spring disposed so as to receive the third trigger stopper and biasing the third trigger stopper when the third trigger stopper is inserted in the second hole portion of the first trigger stopper.

7. The driving machine according to claim 6, wherein spring force of the second spring is larger than the sum of spring forces of the first spring and the third spring.

8. The driving machine according to claim 3, wherein, when the push lever does not contact with the member to be driven, the abutting portion of the first trigger stopper and the trigger abut on each other, so that the trigger is made non-rotatable.

9. The driving machine according to claim 8, wherein, when the push lever is brought in contact with the member to be driven, abutting between the abutting portion and the trigger is released, so that the trigger is made rotatable.

* * * * *